US006691540B2

(12) United States Patent
Höhne et al.

(10) Patent No.: US 6,691,540 B2
(45) Date of Patent: Feb. 17, 2004

(54) METHOD AND APPARATUS FOR PRESETTING PROCESS VARIABLES FOR A ROLLING TRAIN FOR ROLLING METAL STRIPS

(75) Inventors: Joachim Höhne, Erlangen (DE); Friedemann Schmid, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/268,168

(22) Filed: Oct. 10, 2002

(65) Prior Publication Data

US 2003/0046965 A1 Mar. 13, 2003

Related U.S. Application Data

(63) Continuation of application No. PCT/DE02/00502, filed on Feb. 12, 2002.

(51) Int. Cl.[7] ..... B21B 37/16

(52) U.S. Cl. ..... 72/7.2; 72/7.4; 72/8.3; 700/149

(58) Field of Search ..... 72/6.2, 7.1, 7.2, 72/7.4, 8.1, 8.2, 8.3, 11.1, 11.2, 11.6; 700/148, 149, 150

(56) References Cited

U.S. PATENT DOCUMENTS

| | | | | | |
|---|---|---|---|---|---|
| 5,987,948 | A | * | 11/1999 | Neushutz et al. | 72/7.1 |
| 6,216,503 | B1 | * | 4/2001 | Kitajima et al. | 72/7.2 |
| 6,240,756 | B1 | * | 6/2001 | Tsugeno | 72/8.1 |
| 6,430,461 | B1 | * | 8/2002 | Andorfer et al. | 700/148 |

FOREIGN PATENT DOCUMENTS

| | | | | |
|---|---|---|---|---|
| DE | 3026229 | C2 | 7/1989 | B21B/37/00 |
| DE | 19622825 | A1 | 11/1997 | B21B/37/00 |
| DE | 19851554 | A1 | 5/2000 | B21B/37/28 |
| EP | 0811435 | A2 | 12/1997 | B21B/37/28 |

* cited by examiner

*Primary Examiner*—Ed Tolan
(74) *Attorney, Agent, or Firm*—Baker Botts L.L.P.

(57) ABSTRACT

Method and apparatus for presetting process variables in at least one actuating element of a rolling train for rolling metal strips, in which guarantee values are predefined. The guarantee values specified, which cover the intended stipulations and the associated tolerance bands for the quality features of the metal strip, are, for example, strip flatness and/or strip contour and/or strip profile. The tolerance bands of the intended stipulations over a predefinable number of metal strips are taken into account in such a way that an optimum set point calculation of at least one process variable is carried out over the predefined number of metal strips.

14 Claims, 1 Drawing Sheet

METHOD AND APPARATUS FOR PRESETTING PROCESS VARIABLES FOR A ROLLING TRAIN FOR ROLLING METAL STRIPS

CROSS-REFERENCE TO RELATED APPLICATION

This application is a continuation of copending International Application No. PCT/DE02/00502 filed Feb. 12, 2002, which designates the United States.

BACKGROUND OF THE INVENTION

The invention relates to a method and an apparatus for presetting process variables for a rolling train for rolling metal strips, the tolerance bands of the guarantee values over a predefinable number of metal strips being used for the optimum set point calculation of the process variables.

During rolling of a metal strip, in particular during flat rolling, the quality of a metal strip is determined in the form of predefined guarantee values on strip flatness, strip contour and strip profile. In order to achieve these guarantee values, which are used as quality features for a metal strip, actuating elements are used which set the form of the rolling nip, also referred to as the rolling nip profile. The set points for the actuating elements will be referred to below as process variables.

During the rolling of a metal strip, because of high strip temperatures and the associated input of heat into the rolls, thermal crowning builds up dynamically and influences the rolling nip profile over the course of the strip and from strip to strip. In addition, over the lifetime of a roll—depending on the installation location, material rolled and roll material—a more or less pronounced wear contour builds up.

DE 198 51 554 A1 discloses a method and apparatus for presetting a rolling train for rolling a metal strip, the presetting being carried out in such a way that the difference between the profile and/or the flatness of the metal strip as it runs out of the rolling train and a predefined intended profile and/or a predefined intended flatness is a minimum. In this case, the difference between the profile and/or the flatness of the metal strip as it runs out of the rolling train and a predefined intended profile and/or a predefined intended flatness is corrected as a function of the difference between parameters of the metal strip and the corresponding parameters of a metal strip rolled previously.

In order to be able to set the desired rolling gap profile in changeover strips, as they are known, it is often necessary for large set point changes of the process variables to be made. Changeover strips are to be understood as metal strips whose properties differ from the properties of a metal strip rolled previously or which, as compared with a preceding metal strip, are assigned a different rolling program. In the event of pronounced thermal crowning of the rolls, a change in the set points of the process variables often leads to an undesired deviation of the rolling gap profile from its ideal shape. In this case, this effect has a detrimental effect on the required quality features of the strip flatness, strip contour and strip profile.

In the case of previously known apparatuses or methods, attempts were always made to determine the best solution (solution in which the intended stipulations of the guarantee values for strip flatness and/or strip contour and/or strip profile were satisfied to the greatest extent) for the respectively following metal strip. Possible tolerance bands on the intended stipulations were not taken into account in advance.

SUMMARY OF THE INVENTION

On the basis of the prior art, it is an object of the invention to specify a method and an apparatus which permits the required quality features of metal strips to be reached.

According to the invention, the object is achieved by a method of presetting process variables in at least one actuating element of a rolling train for rolling metal strips, in which guarantee values are predefined which cover the intended stipulations and the associated tolerance bands for the quality features of the metal strips, the tolerance bands of the intended stipulations over a predefinable number of metal strips being taken into account in such a way that an optimum set point calculation is carried out in the case of at least one process variable over the predefined number of metal strips.

Another embodiment is a method of presetting process variables in at least one actuating element of a rolling train for rolling metal strips, comprising the steps of:

calculating data with respect to parameters of a current strip;

transmitting the calculated data to a control system;

pre-calculating data with respect to parameters of a plurality of strips to be processed;

storing the pre-calculated data;

marking the stored data of a critical strip;

determining an actuating element limit from the calculated data and the pre-calculated data of the next critical strip;

transmitting the actuating element limit to the control system;

performing a set point calculation from data generated by the control system.

Yet another embodiment is an apparatus for presetting process variables in at least one actuating element of a rolling train for rolling metal strips, in which guarantee values are predefined which cover the intended stipulations and the associated tolerance bands for the quality features of the metal strips, it being possible for a computing system to carry out an optimum set point calculation in at least one process variable over a predefinable number of metal strips, the tolerance bands of the intended stipulations over the predefined number of metal strips being taken into account.

Further developments of the method according to the invention are specified in the dependent claims.

In the method according to the invention, the presetting of process variables of the actuating elements of a rolling train for rolling metal strips is carried out over a predefinable number of metal strips. In this case, the required guarantee values, that is to say intended stipulations and associated tolerance bands for quality features of the metal strips, such as strip flatness and/or strip contour and/or strip profile, over the predefined number of metal strips are taken into account in such a way that, depending on the tolerance bands of the guarantee values, an optimum set point calculation of the process variables of the actuating elements is carried out.

One advantageous refinement of the invention is that at least two metal strips are taken into account for the set point calculation.

In a further advantageous refinement of the invention, the presetting of process variables of the actuating elements in the case of changeover strips is carried out on the basis of the required guarantee values.

One advantageous refinement of the invention is that, in the predefined number of metal strips, those metal strips are identified in which the predefined guarantee values cannot be maintained on the basis of the current set point setting of the process variables. Furthermore, during the identification of critical metal strips, priority features, as they are known, are evaluated. Priority features are, for example, geometric variables (e.g. strip thickness, strip width) and/or material properties (e.g. strength, grade—stainless steel).

In an advantageous refinement of the invention, a new set point calculation of the process variables of the actuating elements is carried out on the basis of the identified metal strips.

A further advantageous refinement of the invention is characterized in that the new set point calculation uses the tolerance bands of the intended stipulations in such a way that the guarantee values of the identified metal strips are reached, there being a deliberate deviation from the intended stipulations in the tolerance band.

The apparatus according to the invention as claimed in claim 7 comprises a computing system for presetting process variables in at least one actuating element of a rolling train for rolling metal strips, in which guarantee values are predefined which cover the intended stipulations and the associated tolerance bands for the quality features of the metal strips. The quality features predefined are, for example, strip flatness and/or strip contour and/or strip profile. In this case, the computing system is constructed in such a way that an optimum set point calculation can be carried out in at least one process variable over a predefinable number of metal strips, the tolerance bands of the intended stipulations over the predefined number of metal strips being taken into account.

BRIEF DESCRIPTION OF THE DRAWINGS

The invention and further advantages and details will be explained in more detail in the following text using an exemplary embodiment illustrated schematically in the drawing, in which.

DETAILED DESCRIPTION OF THE PREFERRED EMBODIMENTS

Figure 1:
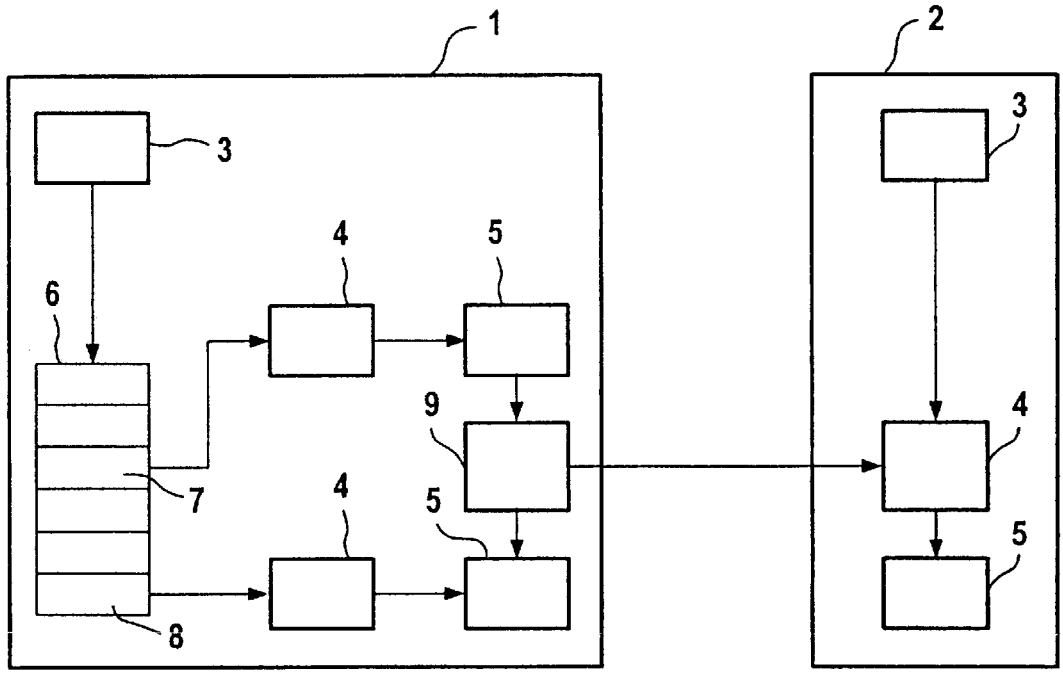
FIG. 1 shows an example of the execution according to the invention of presetting process variables of the actuating elements of a rolling train.

FIG. 1 shows, according to the invention, a method of presetting process variables of the actuating elements of a rolling train for rolling metal strips. In this case, the presetting of process variables is carried out by a known method 2 and an expanded method 1. In the known method 2, process data from the current strip, with respect to strip profile, strip flatness and strip contour, are calculated in the pass plan prior calculation 3. Here, process data, such as rolling force, strip thickness and strip width, are calculated in the pass plan prior calculation 3 and then transmitted to the profile and flatness control system 4. In addition to the known method 2, in the expanded method 1 a pass plan prior calculation 3 is carried out for a predefinable number of metal strips. It has proven to be advantageous in the case of changeover strips as a rule to take account of a number of from two to eight metal strips. However, in the event of very large deviations of the rolling gap profile from its ideal shape, more than eight metal strips can also be taken into account at any time.

In the pass plan prior calculation 3, process data such as rolling force, strip thickness and strip width are calculated for the predefined number of metal strips and stored in a data buffer 6. In addition to the stored process data for each metal strip, critical metal strips 7 are identified and marked as critical. Critical metal strips 7 are identified in the case of the metal strips in which the predefined guarantee values cannot be maintained on the basis of the current set point setting of the process variables of the actuating elements and/or which are defined by priority features. The calculated process data from the identified critical metal strips 7, and the calculated process data from the current metal strip 8, are then transmitted to the profile and flatness control system 4. Depending on process data and plant restrictions, such as mechanical limits, a set point calculation of the process variables 5 for the identified critical metal strips 7 ($S_{critical}$) and for the current metal strip 8 ($S_{current}$) is carried out in the profile and flatness control system 4. The process variables are used to set the rolling gap profile by means of the associated actuating elements. From the calculated set points of the process variables 5 for the current metal strip 8 and for the identified critical metal strips 7, actuating element limits ($S_{limit}$) are defined in the actuating element limit calculation 9, so that the actuating elements are always set in the direction of the identified critical metal strip 7. This avoids excessively high set point jumps for the actuating elements resulting in identified critical metal strips 7, such as during changeover strips. The calculation of the actuating element limits is carried out in accordance with the following rule:

$$S_{limit}=S_{critical}\pm\alpha|S_{current}-S_{critical}|$$

A further alternative calculation of the actuating element limits is carried out in accordance with the following rule:

$$S_{limit}=S_{critical}\pm\Delta s$$

$\Delta s$ is an actuating element range which depends on the position of the identified critical metal strips. The following table shows an example of the definition of $\Delta s$ for the actuating element CVC (roll displacement).

| Position | $\Delta s$ [mm] | Note |
|---|---|---|
| 1 | 10 | The identified critical metal strip will be rolled next. |
| 2 | 20 | The identified critical metal strip will be rolled next but one. |
| 3 | 30 | The identified critical metal strip is in third place. |

The value $\alpha$ represents a factor of 1 to 0, which predefines the actuating element limits. The actuating element limits calculated in the actuating element limit calculation 9 are then transferred to the profile and flatness control system 4 of the known method 2.

Depending on the calculated process data from the pass plan prior calculation 3 of the known method 2, and the calculated actuating element limits of the actuating element limit calculation 9, the new set points of the process variables 5 for the actuating elements are calculated in the profile and flatness control system 4 of the known method 2 in order to set the rolling gap profile.

What is claimed is:

1. A method of presetting process variables in at least one actuating element of a rolling train for rolling metal strips, in which guarantee values are predefined which cover intended stipulations and associated tolerance bands for quality features of the metal strips, the tolerance bands of the intended stipulations over a predefinable number of metal strips being taken into account in such a way that an optimum set point calculation is carried out in the case of at least one process variable over the predefined number of metal strips.

2. The method as claimed in claim 1, wherein at least two metal strips are taken into account for the set point calculation.

3. The method as claimed in claim 1, wherein the presetting of process variables in the case of changeover strips is carried out on the basis of the required guarantee values.

4. The method as claimed in claim 1, wherein in the predefined number of metal strips, those metal strips are identified in which the predefined guarantee values cannot be maintained on the basis of the current set point setting of the process variables and/or the metal strips are defined on the basis of priority features.

5. The method as claimed in claim 4, wherein a new set point calculation of the process variables is carried out on the basis of the identified metal strips.

6. The method as claimed in claim 5, wherein the new set point calculation uses the tolerance bands of the intended stipulations in such a way that the guarantee values of the identified metal strips are reached, there being deliberate deviation from the intended stipulations in the tolerance band.

7. A method of presetting process variables in at least one actuating element of a rolling train for rolling metal strips, comprising the steps of:

calculating data with respect to parameters of a current strip;

transmitting the calculated data to a control system;

pre-calculating data with respect to parameters of a plurality of strips to be processed;

storing the pre-calculated data;

marking the stored data of a critical strip;

determining an actuating element limit from the calculated data and the pre-calculated data of the next critical strip;

transmitting the actuating element limit to the control system; and performing a set point calculation from data generated by the control system.

8. The method as claimed in claim 7, wherein at least two metal strips are taken into account for the set point calculation.

9. The method as claimed in claim 7, wherein the pre-calculating of process data in the case of changeover strips is carried out on the basis of required guarantee values.

10. The method as claimed in claim 7, wherein the step of marking comprises the step of identifying those metal strips in which the predefined guarantee values cannot be maintained on the basis of the current set point setting of the process variables.

11. The method as claimed in claim 7, wherein the step of marking comprises the step of defining the metal strips on the basis of priority features.

12. The method as claimed in claim 10, wherein a new set point calculation of the process data is carried out on the basis of the identified metal strips.

13. The method as claimed in claim 12, wherein the new set point calculation uses tolerance bands of intended stipulations in such a way that guarantee values of the identified metal strips are reached, there being deliberate deviation from the intended stipulations in the tolerance band.

14. An apparatus for presetting process variables in at least one actuating element of a rolling train for rolling metal strips, in which guarantee values are predefined which cover intended stipulations and associated tolerance bands for quality features of the metal strips, wherein a computing system is operable to carry out an optimum set point calculation in at least one process variable over a predefinable number of metal strips, the tolerance bands of the intended stipulations over the predefined number of metal strips being taken into account.

* * * * *

UNITED STATES PATENT AND TRADEMARK OFFICE

CERTIFICATE OF CORRECTION

PATENT NO. : 6,691,540 B2
DATED : February 17, 2004
INVENTOR(S) : Joachim Höhne et al.

It is certified that error appears in the above-identified patent and that said Letters Patent is hereby corrected as shown below:

Title page,
Item [30], please insert the following after Item [63]:
-- [30] Foreign Application Priority Data
February 13, 2001 (DE) ……..……... 10106584.1 --

Signed and Sealed this

Twenty-fifth Day of May, 2004

JON W. DUDAS
*Acting Director of the United States Patent and Trademark Office*